US008391530B2

(12) United States Patent
Grandt et al.

(10) Patent No.: US 8,391,530 B2
(45) Date of Patent: Mar. 5, 2013

(54) HELMET AND APPARATUS FOR ACTIVE NOISE SUPPRESSION

(75) Inventors: Andre Grandt, Wedemark (DE); Manfred Kurbis, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 423 days.

(21) Appl. No.: 12/686,799

(22) Filed: Jan. 13, 2010

(65) Prior Publication Data

US 2010/0183182 A1 Jul. 22, 2010

(30) Foreign Application Priority Data

Jan. 16, 2009 (DE) ..... 10 2009 005 302

(51) Int. Cl.
*H04R 25/00* (2006.01)

(52) U.S. Cl. ..... 381/367; 381/333; 381/334

(58) Field of Classification Search ..... 381/333–334, 381/364, 370–375, 388, 367, 388.7
See application file for complete search history.

(56) References Cited

U.S. PATENT DOCUMENTS

| | | | | |
|---|---|---|---|---|
| 4,644,581 | A | 2/1987 | Sapiejewski | |
| 4,833,719 | A | 5/1989 | Carme et al. | |
| 5,148,887 | A * | 9/1992 | Murphy | 381/376 |
| 5,182,774 | A | 1/1993 | Bourk | |
| 5,208,868 | A | 5/1993 | Sapiejewski | |
| 5,497,426 | A | 3/1996 | Jay | |
| 5,815,582 | A | 9/1998 | Claybaugh et al. | |
| 5,852,667 | A | 12/1998 | Pan et al. | |
| 6,625,287 | B1 | 9/2003 | Wurtz | |
| 6,638,965 | B2 | 10/2003 | Walter et al. | |
| 6,683,965 | B1 | 1/2004 | Sapiejewski | |
| 7,466,838 | B1 * | 12/2008 | Moseley | 381/370 |
| 2003/0026438 | A1 | 2/2003 | Ray et al. | |
| 2003/0228019 | A1 | 12/2003 | Eichler et al. | |
| 2006/0251266 | A1 | 11/2006 | Saunders et al. | |
| 2006/0262938 | A1 | 11/2006 | Gauger et al. | |
| 2007/0274558 | A1 | 11/2007 | Lyon | |

FOREIGN PATENT DOCUMENTS

| | | | |
|---|---|---|---|
| DE | 37 19 963 | A1 | 3/1988 |
| DE | 38 75 717 | T2 | 3/1993 |
| DE | 195 26 124 | C2 | 1/1997 |
| DE | 694 02 413 | T2 | 7/1997 |
| DE | 101 15 714 | A1 | 10/2002 |
| DE | 10 2004 044 280 | A1 | 3/2006 |
| DE | 10 2005 052 548 | A1 | 5/2007 |
| EP | 0 195 641 | B1 | 6/1993 |
| EP | 0 423 172 | B1 | 1/1997 |
| EP | 1 077 012 | B1 | 6/2002 |
| EP | 0 737 022 | A2 | 10/2006 |
| GB | 2 234 881 | A | 2/1991 |
| GB | 2 265 790 | A | 10/1993 |
| JP | 2005-189836 | A | 7/2005 |

(Continued)

*Primary Examiner* — Suhan Ni
(74) *Attorney, Agent, or Firm* — Kilpatrick Townsend & Stockton LLP

(57) ABSTRACT

There is provided a safety helmet (1) having an outer helmet shell (2), shock-absorbing material (3) and an electroacoustic transducer (5) for the delivery of a sound signal. The shock-absorbing material (3) has an outside (4) and is arranged within the outer helmet shell (2) with the outside (4) adjacent to the outer helmet shell (2). The electroacoustic transducer (5) is arranged in that case at the outside (4) of the shock-absorbing material (3).

12 Claims, 2 Drawing Sheets

FOREIGN PATENT DOCUMENTS

| | | | |
|---|---|---|---|
| WO | WO 99/05998 | A1 | 2/1999 |
| WO | WO 00/06065 | A1 | 2/2000 |
| WO | WO 03/010993 | A2 | 2/2003 |
| WO | WO 2005/046543 | A1 | 5/2005 |
| WO | WO 2005/112850 | A2 | 12/2005 |
| WO | WO 2006/125679 | A2 | 11/2006 |

* cited by examiner

HELMET AND APPARATUS FOR ACTIVE NOISE SUPPRESSION

CROSS-REFERENCE TO RELATED APPLICATIONS

The present application claims priority to German Patent Application No. 10 2009 005 302.6, filed Jan. 16, 2009, the entire contents of which are herein incorporated by reference for all purposes.

The invention concerns a safety helmet and a device for active background noise suppression.

BACKGROUND

Various kinds of safety helmets such as for example motorcycle helmets, bicycle helmets, helmets which are worn by pilots, safety helmets or hard hats which are worn on building sites and safety helmets for tank drivers are known. The function of those helmets is in particular to protect the heads of their wearers from blows and accidents. In the general situation such helmets are used in an environment in which, besides an increased risk of blows, there is also an increased level of noise or interfering background sound. In such environments background noise suppression, particularly to protect a helmet wearer from interfering background noise, and also the interference-free use of communication means, in particular communication means for listening or talking, represents a technical challenge.

U.S. Pat. No. 6,683,965 B1 discloses an in-the-ear earphone for noise reduction. Disposed on the earphone is a cushion with a cavity, that is arranged in the ear of a user. Disposed in the cavity are a loudspeaker and a microphone which is mounted to the loudspeaker. That headphone structure is then used for noise reduction.

SUMMARY

Accordingly an object of the invention is to provide a safety helmet which, besides a protective function, also has communication functions such as for example listening to a sound signal from a loudspeaker.

A further object of the present invention is to provide a device with which a background noise which is variable in respect of time can be suppressed.

Those objects are attained by a safety helmet, e.g, as set forth in claim 1.

Thus there is provided a safety helmet having an outer helmet shell, shock-absorbing material and an electroacoustic transducer for the delivery of a sound signal. The shock-absorbing material has an outside and an inside and is arranged within the outer helmet shell with the outside adjacent to the outer helmet shell. The electroacoustic transducer is arranged in that case at the outside of the shock-absorbing material.

The safety helmet serves in particular for shock absorption.

In accordance with an aspect of the invention the safety helmet has a first microphone for recording a reference sound. The first microphone can serve in particular for recording a background noise. It is arranged for example within or outside the safety helmet (in or on the helmet).

In accordance with an aspect of the invention the safety helmet has a second microphone for recording a speech signal. The second microphone is for example arranged in such a way that, when the safety helmet is being worn, it is adjacent to the mouth or in the proximity of the mouth of the wearer. Such a safety helmet accordingly also has the functionality of a headset.

In accordance with an aspect of the invention the first microphone is fixed to an inside of the shock-absorbing material, that is opposite to the outside. Fixing the first microphone to the shock-absorbing material has the advantage that, in the event of a blow acting on the safety helmet, a movement of the microphone from the inside in the direction of the outer helmet shell is achieved.

In accordance with an aspect of the invention the first microphone is arranged at the inside of the shock-absorbing material at a location which bears substantially against an ear entrance when the safety helmet is being worn.

In accordance with an aspect of the invention the shock-absorbing material is weakened behind the first microphone. Alternatively to the weakening the material may also have a bore behind the first microphone. The weakening or the bore serves to provide that the shock-absorbing material can receive the microphone in the event of a blow on the safety helmet. Injuries to the head, which are caused by the microphone, can be avoided in that way.

In accordance with an aspect of the invention at least one acoustic duct through the shock-absorbing material acoustically connects the electroacoustic transducer and an inner region of the safety helmet. The at least one acoustic duct serves to transport the sound that the electroacoustic transducer delivers through the shock-absorbing material into an inner region of the helmet. Preferably the sound is to be transported in such a way that it is passed to the ear of the wearer when the safety helmet is being worn. The ducts can be of such a configuration that a volume between the ear and the acoustic transducer is minimised. Preferably air or a medium with a low level of sound attenuation is preferred as the medium in the at least one acoustic duct. The at least one acoustic duct is introduced into the shock-absorbing material. The remaining shock-absorbing material further has a shock-absorbing action between the ear or head and the helmet shell.

In accordance with an aspect of the present invention the electroacoustic transducer does not touch the outer helmet shell. The fact that the electroacoustic transducer does not touch the outer helmet shell means that the electroacoustic transducer is acoustically decoupled from the outer helmet shell. That means for example that the sound delivered by the electroacoustic transducer is shielded from the outer helmet shell and accordingly cannot penetrate outwardly or can do so only with difficulty. The sound can pass in particular from the transducer by way of acoustic ducts to an ear. In that way the predominant part of the acoustic power is delivered to the ear and only a minimum possible part of the acoustic power is radiated.

In an aspect of the invention the safety helmet has at least one ear cushion adapted to acoustically seal off an ear. Such an ear cushion on the one hand reduces the background noise which passes to the ear from the exterior when the safety helmet is being worn. In addition a corresponding ear cushion prevents an excessively large proportion of sound which goes from the electroacoustic transducer to the ear through the ear cushion leaving the region of the ear. That acoustic sealing effect is achieved for example by the provision at the edge of the ear cushion of a rubber layer which bears against the head of the wearer around the ear when the safety helmet is being worn.

In accordance with an aspect of the present invention at least one acoustic duct acoustically connects the electroacoustic transducer and an inner region of the ear cushion. The acoustic connection signifies for example that sound can pass from the electroacoustic transducer into the inner region of the ear cushion by way of the acoustic duct. When the safety helmet is being worn a volume between the electroacoustic transducer and an ear entrance is restricted. The restriction in that volume provides for efficient transmission of the sound delivered by the electroacoustic transducer to the ear entrance.

The invention also concerns a device for active background noise suppression comprising an electroacoustic transducer for the delivery of a compensation noise and a first microphone for measuring a reference sound. In that case the electroacoustic transducer is arranged remote from the first microphone.

The device for active background noise suppression further has a signal processing unit adapted to control the electroacoustic transducer in such a way that a background noise at the location of the first microphone is compensated. The background noise is generally variable in respect of time and occurs at a location removed from the first microphone. The first microphone records the background noise at a given location in a given environment. That recorded background noise is referred to as reference sound. Now the purpose of active background noise suppression is to control the electroacoustic transducer in such a way that it delivers a compensation noise which as far as possible compensates for the background noise at the location of the first microphone. In particular the signal processing unit is adapted to actuate the electroacoustic transducer in accordance with the aforementioned aim on the basis of the reference sound recorded by the first microphone.

The invention further concerns a headphone having a device according to the invention for active background noise suppression. Particularly in the case of a headphone it is possible to arrange the active background noise suppression device in such a way that the microphone is as close as possible to an ear while the electroacoustic transducer is as far as possible away from the ear.

Developments of the invention are defined in the appendant claims.

BRIEF DESCRIPTION OF THE DRAWINGS

These and other aspects of the invention are described hereinafter with reference to the Figures in which.

DETAILED DESCRIPTION

Figure 1:
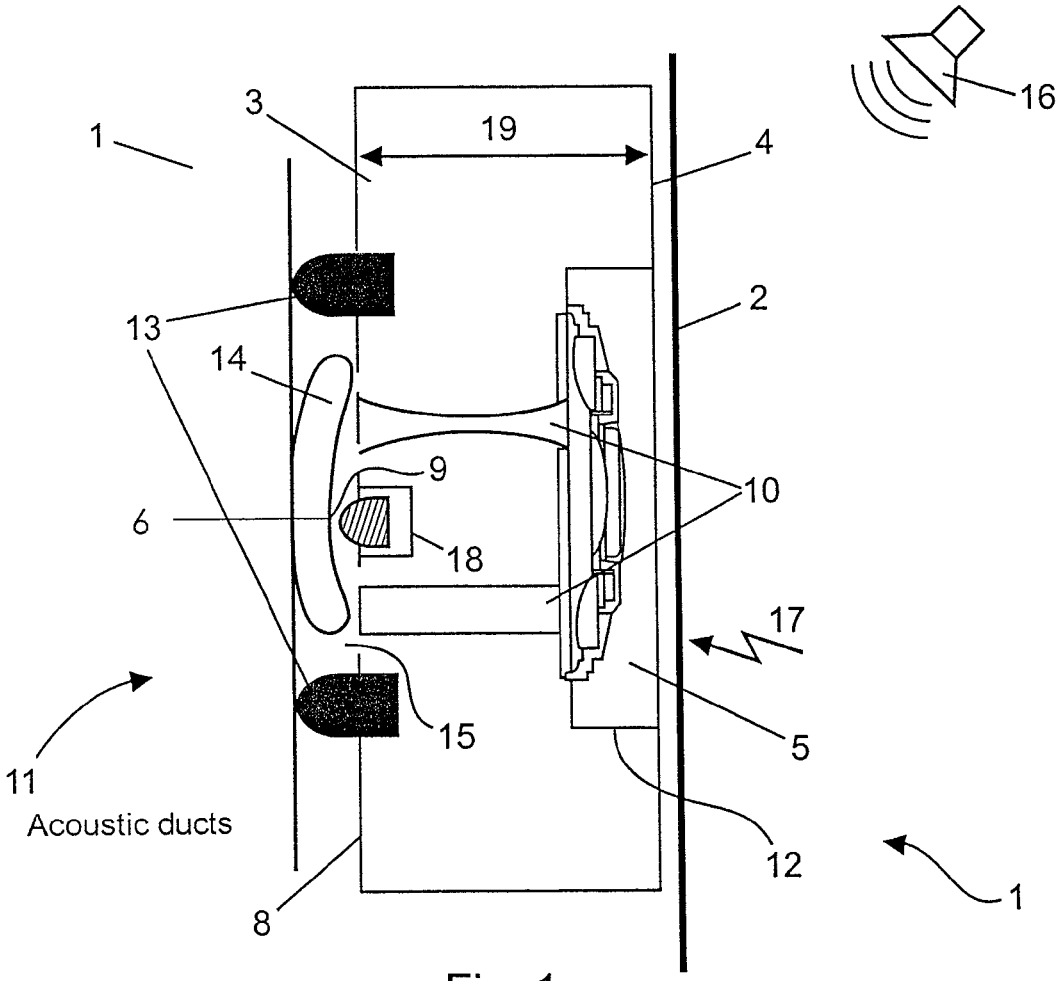
FIG. 1 shows a portion of a safety helmet configured for a first ear according to the invention in a first embodiment.

FIG. 1 shows a portion of a safety helmet 1 in accordance with a first embodiment, having an outer helmet shell 2 and an inner region 11 of the safety helmet. The safety helmet 1 is lined with a shock-absorbing material 3. It has an outside 4 and an inside 8. The outside 4 of the shock-absorbing material 3 is adjacent to the outer helmet shell 2. The outside 4 of the shock-absorbing material 3 can optionally have a recess 12. An electroacoustic transducer 5 can be arranged in that recess 12. The electroacoustic transducer 5 preferably does not touch the outer helmet shell 2. The sound which is delivered by the electroacoustic transducer can pass to an ear 14 by way of an acoustic duct 10. The acoustic duct 10 is a bore or a plurality of bores through the shock-absorbing material 3. The ear 4 is arranged in an inner region 15 of an ear cushion 13. Optionally a first microphone 6 can be fixed to the shock-absorbing material 3 in such a way that, when the safety helmet 1 is being worn, the microphone is disposed for example centrally at an ear entrance 9. A bore 18 for receiving the first microphone 6 can be provided behind the first microphone 6. In addition a background noise source 16 is shown, which gives off a background noise, and the effect of a blow 17 representing a blow on the outer helmet shell 2.

In the event of a blow 17 acting on the outer helmet shell 2 the outer helmet shell 2 is pressed towards the recess 12 so that the effect of the blow acts on the shock-absorbing material 3 by way of edges of the recess 12. The shock-absorbing material 3, together with the optional first microphone 6, the electroacoustic transducer 5 and the outer helmet shell is compressed in the direction of the ear 14. In that case the ear cushion 13 is compressed and a complete width 19 of the shock-absorbing material can act in opposition to the effect 17 of the blow. In regard to the effect of the blow, the optional first microphone 6 is accommodated by the bore 18 so as to avoid injury at the ear 14, which could be caused by the first microphone 6. The arrangement of the electroacoustic transducer 5 at the outside 4 of the shock-absorbing material 3 means that substantially the entire width of the shock-absorbing material has a shock-absorbing action when the blow 17 acts on the helmet. Arranging the electroacoustic transducer 5 at the inside 8 of the shock-absorbing material 3 would reduce the effective width of the shock-absorbing material 3 and thus diminish the shock-absorbing properties of the safety helmet 1. Likewise arranging the electroacoustic transducer 5 for example centrally in the shock-absorbing material 3 would reduce the shock-absorbing properties of the shock-absorbing material 3.

The arrangement of the electroacoustic transducer 5 and the optional first microphone 6 in the safety helmet 1 serves to suppress a background noise at the entrance to the ear 14. A background noise is produced by the background noise source 16 outside the outer helmet shell 2. Attenuation of the background noise is already achieved by the ear cushion 13 and the safety helmet 1. The remaining background noise at the ear entrance 9 is recorded by the optional first microphone 6. That recorded reference signal is made available for example to a signal processing unit which controls the electroacoustic transducer 5. The electroacoustic transducer 5 then outputs a compensation sound which is intended to compensate for the background noise at the first microphone 6. That provides for active background noise suppression. The compensation sound from the electroacoustic transducer 5 passes to the ear 14 by way of acoustic ducts 10. The inner region 15 of the ear cushion 13, the acoustic ducts 10 and the electroacoustic transducer 5 as well as a part, surrounding the ear 14, of the head of a person wearing the safety helmet define a volume which serves for the transmission of sound from the electroacoustic transducer 5 to the ear entrance 9. That volume limitation provides for good acoustic transmission of the compensation sound from the electroacoustic transducer 5 to the ear entrance. The limitation of that volume means that an only very low level of compensation sound acoustic power is required. In addition the restricted volume provides that the background noise cannot easily penetrate outwardly, that is to say it cannot easily leave the defined volume. In addition the electroacoustic transducer does not touch the outer helmet shell 2 so that here there is no acoustic coupling. Active background noise suppression can be achieved with the principles shown in FIG. 1 without markedly diminishing the shock-absorbing properties of the shock-absorbing material 3.

The safety helmet 1 according to the invention can be for example a motorcycle helmet, a bicycle helmet, a helmet as is usually worn on building sites, a helmet for a pilot or a helmet for a tank driver or comparable helmets. Such helmets generally comprise an outer helmet shell lined with shock-absorbing material. The electroacoustic transducer 5 serves for example to deliver a speech signal which was received for example from a cellular telephone, or a music or radio signal. The electroacoustic transducer 5 can be arranged at the outside 4 of the shock-absorbing material 3. That is effected for example by the outside 4 of the shock-absorbing material 3 having a bore in which the electroacoustic transducer is disposed. The electroacoustic transducer 5 is then within the outer helmet shell 2 at the outside 4 of the shock-absorbing material 3. That has the advantage that the shock-absorbing effect of the safety helmet 1 is not reduced or is only slightly reduced. Arranging the electroacoustic transducer 5 for example at the inside 8 would in contrast lessen the shock-absorbing action of the safety helmet. The described safety helmet 1 thus provides a function for listening to acoustic signals without noticeably reducing the shock-absorbing effect.

The reference signal recorded by the first microphone 6 can be passed for example to a signal processing unit (active noise reduction unit or ANR) which on the basis of the reference signal controls the electroacoustic transducer 5 in such a way that it delivers a compensation sound to reduce the background noise. Such a safety helmet is accordingly suitable for providing for background noise suppression without noticeably lessening the shock-absorbing properties of the safety helmet.

Figure 3:
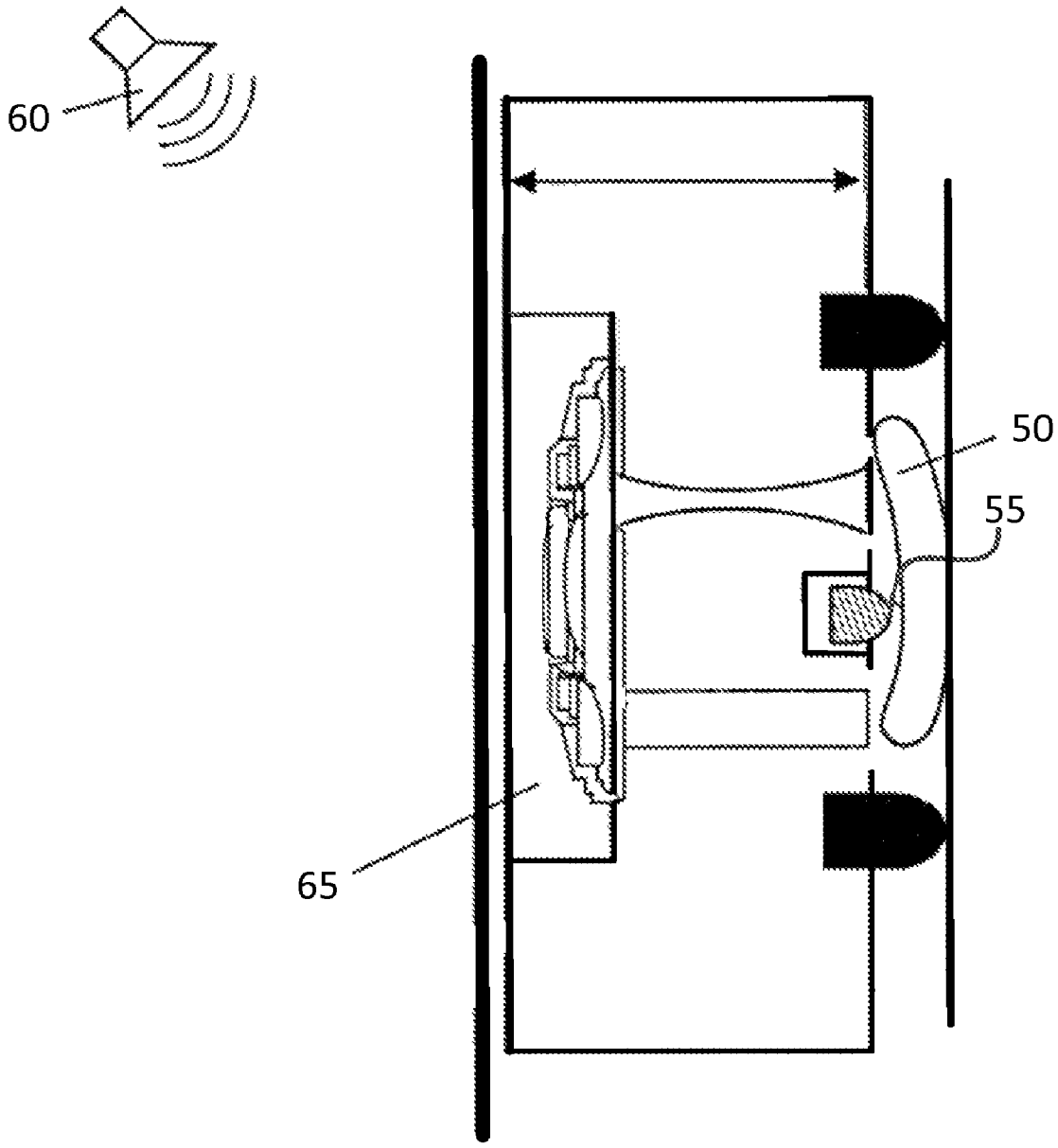
FIG. 3 shows a portion of a safety helmet configured for a second ear according to the invention in a third embodiment.

When the first microphone 6 is arranged in the region of the ear entrance 9 the reference signal is recorded when the safety helmet 1 is being worn, in the proximity of the ear 14. Active background noise suppression is intended in particular to suppress the background noise at the entrance to the ear 14. It is advantageous to record a reference signal at that appropriate location as good background noise suppression can be achieved on the basis of that reference signal. Accordingly the first microphone 6 is preferably so disposed that, when the safety helmet 1 is being worn, it is disposed centrally in the region of the ear entrance 9. For the second ear 50, it is possible to use a further reference microphone 55 which records a second reference signal 60, as shown in FIG. 3. In addition to the second reference microphone 55, a second electroacoustic transducer 65 can be arranged for the second ear 50. Background noise suppression can thus be individually implemented for each ear. With such an arrangement, when a blow acts on the helmet, the first microphone can move away in the direction of the helmet shell, together with the head and the ear.

The electroacoustic transducer 5 can have an inverted cup. It is particularly preferable for the acoustic transducer to be of as flat a structure as possible as in that way the shock-absorbing material only has to have a thin bore to be able to accommodate the acoustic transducer. Shock absorption is then only minimally influenced. A flat structure for an electroacoustic transducer is possible in particular by the use of an inverted cup.

The electroacoustic transducer 5 can be arranged in a recess 12 in the outside 4 of the shock-absorbing material 3. Preferably the position of the recess 12 is opposite to the ear 14 of a wearer, when the helmet is being worn. In that way it is possible for example to reduce the required length of the at least one acoustic duct 10 and the acoustic power which does not pass to the ear 14 or to a position intended for the ear 14 can be minimised.

Figure 2:
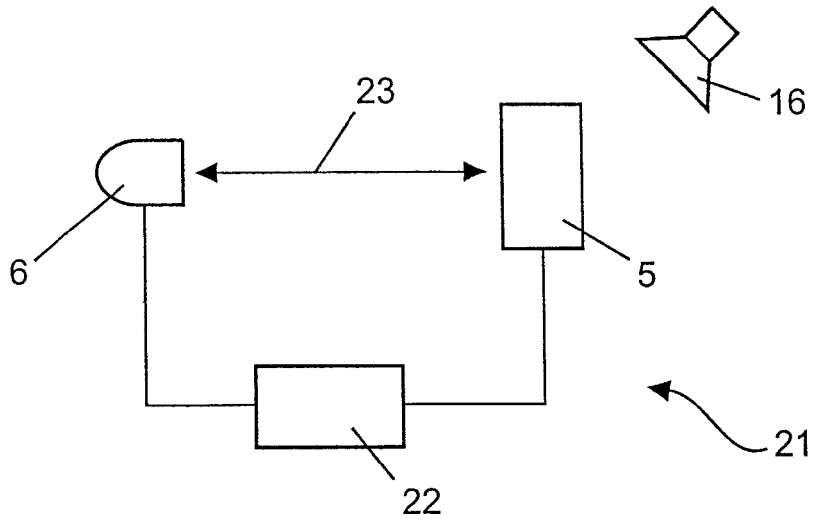
FIG. 2 shows a portion of a device according to the invention for active background noise suppression in accordance with a second embodiment.

FIG. 2 shows a block circuit diagram of a device 21 for active background noise suppression in accordance with a second embodiment. It has a signal processing unit 22 connected to a first microphone 6 and an electroacoustic transducer 5. A distance 23 between the first microphone 6 and the electroacoustic transducer 5 is adjustable and is preferably more than 1 cm, particularly preferably more than 2 cm, in particular preferably more than 3 cm. The signal processing unit 22 actuates the electroacoustic transducer 5 in such a way that a noise signal produced by a background noise sound source 16 is compensated at the first microphone 6. For that purpose the signal processing unit 22 uses a reference signal recorded by the first microphone 6. The device 21 for active background noise suppression is particularly suitable for being fitted into a safety helmet. The variable distance 23 between the first microphone 6 and the electroacoustic transducer 5 affords for example the possibility of fitting the electroacoustic transducer 5 at the outside of a shock-absorbing material while the first microphone can be fitted at the inside of the shock-absorbing material. The device 21 for active background noise suppression can accordingly be integrated into a safety helmet in such a way as to afford a safety helmet as shown in FIG. 1. Alternatively however the corresponding active background noise suppression device 21 can also be arranged in an earphone.

The distance 23 between the first microphone and the electroacoustic transducer is preferably at least 1 cm, particularly preferably at least 2 cm, in particular preferably at least 5 cm. The first microphone 6 is preferably arranged in the proximity of an ear while the electroacoustic transducer 5 is preferably further away from the ear, than the first microphone 6. For example shock-absorbing material can be introduced into the space between the first microphone 6 and the electroacoustic transducer 5. A corresponding device can be integrated for example in a safety helmet. Preferably the active background noise suppression device 21 is a component part of a safety helmet according to the invention or is suitable, together with a known safety helmet, for forming a safety helmet according to the invention.

In accordance with the invention there can be provided a safety helmet which has an active noise compensating reduction functionality.

The invention claimed is:

1. A safety helmet comprising:

an outer helmet shell;

shock-absorbing material having an outside and an inside, wherein the shock-absorbing material is arranged within the outer helmet shell and with the outside adjacent to the outer helmet shell;

a first microphone for recording a reference sound, wherein the first microphone is arranged at the inside of the shock-absorbing material at a location which bears substantially against an ear entrance when the safety helmet is being worn; and at least one electroacoustic transducer for the delivery of a sound signal, wherein the at least one electroacoustic transducer is arranged at the outside of the shock-absorbing material.

2. A safety helmet as set forth in claim 1 and further comprising a second microphone for recording a speech signal.

3. A safety helmet as set forth in claim 1 wherein the first microphone is fixed to an inside of the shock-absorbing material.

4. A safety helmet as set forth in claim 1 wherein an elastic fixing for the first microphone is such that the first microphone can move away in the direction of the outer helmet shell.

5. A safety helmet as set forth in claim 1 wherein the shock-absorbing material is weakened behind the first microphone.

6. A safety helmet as set forth in claim 1 wherein the electroacoustic transducer has an inverted cup.

7. A safety helmet as set forth in claim 1 and further comprising at least one acoustic duct through the shock-absorbing material for acoustically connecting the electroacoustic transducer to an inner region of the safety helmet.

8. A safety helmet as set forth in claim 1 wherein the electroacoustic transducer is provided at a spacing relative to the outer helmet shell.

9. A safety helmet as set forth in claim 1 wherein the electroacoustic transducer is arranged in a recess in the outside of the shock-absorbing material.

10. A safety helmet as set forth in claim 1 and further comprising at least one ear cushion for acoustically sealing off an ear.

11. A safety helmet as set forth in claim 10 and further comprising at least one acoustic duct for acoustically connecting the electroacoustic transducer to an inner region of the ear cushion.

12. A safety helmet comprising:

an outer helmet shell;

shock-absorbing material having an outside and an inside, wherein the shock-absorbing material is arranged within the outer helmet shell and with the outside adjacent to the outer helmet shell; and at least one electroacoustic transducer for the delivery of a sound signal, wherein the at least one electroacoustic transducer is arranged between the outside of the shock-absorbing material and the inside and the inside of the outer helmet shell.

* * * * *

UNITED STATES PATENT AND TRADEMARK OFFICE

CERTIFICATE OF CORRECTION

PATENT NO. : 8,391,530 B2
APPLICATION NO. : 12/686799
DATED : March 5, 2013
INVENTOR(S) : Grandt et al.

It is certified that error appears in the above-identified patent and that said Letters Patent is hereby corrected as shown below:

In the Abstract:

On the title page, at item [57], line 7, please insert a -- , -- after "arranged".

On the title page, at item [57], line 7 please insert a -- , -- after "case".

In the Specification:

In column 1, line 17, please insert a -- , -- before "such".

In column 1, line 17, please insert a -- , -- before and after the phrase "for example".

In column 1, line 20, please insert a -- , -- before "are known.".

In column 1, line 21, please insert a -- , -- before and after the phrase "in particular".

In column 1, line 23, please insert a -- , -- after "situation".

In column 1, line 41, please insert a -- , -- after "Accordingly".

In column 1, line 43, please insert a -- , -- before and after the phrase "for example".

In column 1, line 46, please insert a -- , -- after "noise".

In column 1, line 47, please insert a -- , -- after "time".

In column 1, line 50, please insert a -- , -- after "Thus".

In column 1, line 56, please insert a -- , -- before and after the phrase "in that case".

In column 1, line 59, please insert a -- , -- after "invention".

Signed and Sealed this
Fifteenth Day of October, 2013

Teresa Stanek Rea
*Deputy Director of the United States Patent and Trademark Office*

In the Specification:

In column 1, line 61, please insert a -- , -- before and after the phrase “in particular”.

In column 1, line 62, please insert a -- , -- before and after the phrase “for example”.

In column 1, line 64, please insert a -- , -- after “invention”.

In column 1, line 66, please insert a -- , -- before and after the phrase “for example”.

In column 2, line 2, please insert a -- , -- before and after the phrase “accordingly”.

In column 2, line 4, please insert a -- , -- after “invention”.

In column 2, line 11, please insert a -- , -- after “invention”.

In column 2, line 15, please insert a -- , -- after “invention”.

In column 2, line 17, please insert a -- , -- after “weakening”.

In column 2, line 23, please insert a -- , -- after “invention”.

In column 2, line 29, please insert a -- , -- after “Preferably”.

In column 2, line 33, please insert a -- , -- after “Preferably”.

In column 2, line 39, please insert a -- , -- after “invention”.

In column 2, line 44, please insert a -- , -- before and after the phrase “for example”.

In column 2, line 52, please insert a -- , -- after “invention”.

In column 2, line 54, please insert a -- , -- before and after the phrase “on the one hand”.

In column 2, line 56, please insert a -- , -- after “addition”.

In column 2, line 57, please insert a -- , -- after “sound”.

In column 2, line 58, please insert a -- , -- after “ear”.

In column 2, line 60, please insert a -- , -- before and after the phrase “for example”.

In column 2, line 64, please insert a -- , -- after “invention”.

In column 2, line 67, please insert a -- , -- before and after the phrase “for example”.

In column 3, line 3, please insert a -- , -- after “worn”.

In column 3, line 11, please insert a -- , -- after “case”.

In column 3, line 12, please delete “remote” and insert -- remotely --.

In the Specification:

In column 3, line 25, please insert a -- , -- before and after the phrase “as far as possible”.

In column 3, line 27, please insert a -- , -- after “particular”.

In column 3, line 33, please insert a -- , -- after “headphone”.

In column 3, line 46, please insert a -- , -- after “ear”.

In column 3, line 47, please insert a -- , -- after “device”.

In column 3, lines 47-48, please insert a -- , -- after “invention”.

In column 3, line 48, please insert a -- , -- after “suppression”.

In column 3, line 51, please insert a -- , -- after “ear”.

In column 4, line 1, please delete “ear 4” and insert -- ear 14 --.

In column 4, line 2, please insert a -- , -- after “Optionally”.

In column 4, line 4, please insert a -- , -- after “disposed”.

In column 4, line 5, please insert a -- , -- after “example”.

In column 4, line 7, please insert a -- , -- after “addition”.

In column 4, line 10, please insert a -- , -- after “shell 2”.

In column 4, line 15, please insert a -- , -- after “shell”.

In column 4, line 16, please insert a -- , -- after “case”.

In column 4, line 30, please insert a -- , -- after “Likewise”.

In column 4, line 30, please insert a -- , -- after “5”.

In column 4, line 31, please insert a -- , -- after “example”.

In column 4, line 42, please insert a -- , -- after “available”.

In column 4, line 43, please insert a -- , -- after “example”.

In column 4, line 51, please insert a -- , -- after “5”.

In column 4, line 52, please insert a -- , -- after “helmet”.

In column 4, line 58, please delete “an only” and insert -- only a --.

In column 4, line 59, please insert a -- , -- after “addition”.

In the Specification:

In column 4, line 62, please insert a -- , -- after “addition”.

In column 5, line 1, please insert a -- , -- before and after the phrase “according to the invention”.

In column 5, lines 1-2, please insert a -- , -- before and after “for example”.

In column 5, line 6, please insert a -- , -- after “serves”.

In column 5, line 6, please insert a -- , -- after “received”.

In column 5, line 7, please insert a -- , -- after “example”.

In column 5, line 7, please insert a -- , -- after “serves”.

In column 5, line 8, please insert a -- , -- after “example”.

In column 5, line 10, please insert a -- , -- after “effected”.

In column 5, line 11, please insert a -- , -- after “example”.

In column 5, line 17, please insert a -- , -- after “5”.

In column 5, line 18, please insert a -- , -- after “example”.

In column 5, line 24, please insert a -- , -- before and after the phrase “for example”.

In column 5, line 25, please insert a -- , -- before and after “which”.

In column 5, line 26, please insert a -- , -- after “signal”.

In column 5, line 33, please insert a -- , -- after “9”.

In column 5, line 39, please insert a -- , -- after “Accordingly”.

In column 5, line 62, please insert a -- , -- after “Preferably”.

In column 5, line 63, please insert a -- , -- after “way”.

In column 5, line 64, please insert a -- , -- before and after the phrase “for example”.

In column 5, line 67, please replace “minimised” with “minimized”.

In column 6, line 13, please insert a -- , -- after “purpose”.

In column 6, line 18, please insert a -- , -- before and after the phrase “for example”.

In column 6, line 24, please insert a -- , -- before and after “however”.

In column 6, line 34, please insert a -- , -- after “example”.

In the Specification:

In column 6, line 36, please insert a -- , -- after “integrated”.

In column 6, line 37, please insert a -- , -- after “example”.

In column 6, line 37, please insert a -- , -- after “Preferably”.

In column 6, line 39, please insert a -- , -- before and after the phrase “according to the invention”.

In column 6, line 42, please insert a -- , -- after the “invention”.